US012359329B2

(12) United States Patent
Villalon, Jr. et al.

(10) Patent No.: US 12,359,329 B2
(45) Date of Patent: Jul. 15, 2025

(54) SYSTEMS AND METHODS FOR FEEDING SOLID MATERIAL AND A GAS INTO AN ELECTROLYTIC CELL

(71) Applicant: Phoenix Tailings, Inc., Woburn, MA (US)

(72) Inventors: Thomas Anthony Villalon, Jr., Boston, MA (US); Richard Robert Salvucci, Quincy, MA (US)

(73) Assignee: Phoenix Tailings, Inc., Woburn, MA (US)

( * ) Notice: Subject to any disclaimer, the term of this patent is extended or adjusted under 35 U.S.C. 154(b) by 0 days.

(21) Appl. No.: 18/463,776

(22) Filed: Sep. 8, 2023

(65) Prior Publication Data

US 2024/0084468 A1 Mar. 14, 2024

Related U.S. Application Data

(60) Provisional application No. 63/405,185, filed on Sep. 9, 2022.

(51) Int. Cl.
*C25C 3/00* (2006.01)
*C25C 3/14* (2006.01)
(Continued)

(52) U.S. Cl.
CPC ..... *C25C 3/14* (2013.01); *C25C 3/22* (2013.01); *C25C 7/005* (2013.01); *C25C 7/06* (2013.01)

(58) Field of Classification Search
CPC .. C25C 3/14; C25C 3/22; C25C 7/005; C25C 7/06
See application file for complete search history.

(56) References Cited

U.S. PATENT DOCUMENTS 2,861,030 A 11/1958 Slatin
4,592,812 A 6/1986 Beck et al.
(Continued)

FOREIGN PATENT DOCUMENTS

CN 201024217 Y 2/2008
EP 0 224 400 A1 6/1987
(Continued)

OTHER PUBLICATIONS

CN108179443; Liang, Ke; 2019; China (Year: 2019).*
(Continued)

*Primary Examiner* — Zulmariam Mendez
(74) *Attorney, Agent, or Firm* — Wolf, Greenfield & Sacks, P.C.

(57) ABSTRACT

Systems and methods for feeding solid material and a gas into a container (e.g., electrolytic cell) are generally described. Certain methods comprise feeding solid material and a gas into an electrolytic cell through an inlet; wherein: the gas comprises an inert gas; and the inlet is positioned, relative to an anode of the electrolytic cell, within a distance that is less than or equal to 5 times the shortest cross-sectional dimension of the anode. Certain systems comprise a container configured for molten salt electrolysis; a passageway configured for feeding solid material and a gas into the container; an anode; a cathode; and an outlet configured for releasing a gas from the container; wherein an inlet from the passageway to the container is positioned, relative to the anode, within a distance that is less than or equal to 5 times the shortest cross-sectional dimension of the anode.

26 Claims, 4 Drawing Sheets

(51) Int. Cl.

| | |
|---|---|
| ***C25C 3/22*** | (2006.01) |
| ***C25C 7/00*** | (2006.01) |
| ***C25C 7/06*** | (2006.01) |

(56) References Cited

U.S. PATENT DOCUMENTS

| | | | | |
|---|---|---|---|---|
| 4,620,905 | A | 11/1986 | Tarcy et al. | |
| 4,744,876 | A | 5/1988 | Bernard et al. | |
| 4,865,701 | A | 9/1989 | Beck et al. | |
| 5,368,702 | A | 11/1994 | de Nora | |
| 5,759,382 | A | 6/1998 | Utigard et al. | |
| 5,810,993 | A | 9/1998 | Keller et al. | |
| 5,938,914 | A | 8/1999 | Dawless et al. | |
| 6,179,344 | B1 * | 1/2001 | Marsden | B67D 7/0238 285/364 |
| 6,758,991 | B2 | 7/2004 | DiMilia et al. | |
| 7,144,483 | B2 | 12/2006 | Siljan et al. | |
| 11,186,897 | B2 | 11/2021 | Mann et al. | |
| 2007/0278107 | A1 | 12/2007 | Barnett et al. | |
| 2016/0108532 | A1 * | 4/2016 | Powell, IV | C25C 3/04 204/244 |
| 2022/0267918 | A1 | 8/2022 | Jastrzebski et al. | |

FOREIGN PATENT DOCUMENTS

| | | | |
|---|---|---|---|
| EP | 1 811 062 | A1 | 7/2007 |
| RU | 2 154 127 | C1 | 8/2000 |
| RU | 2402643 | C1 | 10/2010 |

OTHER PUBLICATIONS

PCT/US2023/032326, Mar. 20, 2024, International Search Report and Written Opinion.

International Search Report and Written Opinion for International Application No. PCT/US2023/032326 dated Mar. 20, 2024.

Written Opinion of the International Preliminary Examining Authority for International Application No. PCT/US2023/032326 dated Sep. 5, 2024.

International Preliminary Report on Patentability (Chapter 2) for International Application No. PCT/US2023/032326 dated Dec. 12, 2024.

* cited by examiner

SYSTEMS AND METHODS FOR FEEDING SOLID MATERIAL AND A GAS INTO AN ELECTROLYTIC CELL

RELATED APPLICATIONS

This application claims priority under 35 U.S.C. § 119(e) to U.S. Provisional Application No. 63/405,185, filed Sep. 9, 2022, and entitled "Systems and Methods for Feeding Solid Material and a Gas into an Electrolytic Cell," which is incorporated herein by reference in its entirety for all purposes.

TECHNICAL FIELD

Systems and methods for feeding solid material and a gas into an electrolytic cell are generally described.

SUMMARY

The present disclosure is directed to systems and methods for feeding solid material and a gas into an electrolytic cell. Certain aspects are related to feeding solid material and a gas into an electrolytic cell through an inlet. In certain embodiments, the inlet can be positioned such that it is relatively close to one or more anodes of the electrolytic cell. The subject matter of the present disclosure involves, in some cases, interrelated products, alternative solutions to a particular problem, and/or a plurality of different uses of one or more systems and/or articles.

Certain aspects are related to methods.

In some embodiments, the method comprises feeding solid material and a gas into an electrolytic cell through an inlet; wherein: the gas comprises an inert gas; and the inlet is positioned, relative to an anode of the electrolytic cell, within a distance that is less than or equal to 5 times the shortest cross-sectional dimension of the anode.

In some embodiments, the method comprises feeding solid material and a gas into an electrolytic cell through an inlet; wherein: the gas comprises an inert gas, the electrolytic cell comprises one or more anodes and one or more cathodes, and the inlet is positioned closer to one of the anodes than to any of the cathodes.

Certain aspects are related to systems.

In some embodiments, the system comprises a container configured for molten salt electrolysis; a passageway fluidically connected to the container and configured for feeding solid material and a gas into the container; an anode at least partially within the container; a cathode at least partially within the container; and an outlet at or near the top of the container configured for releasing a gas from the container; wherein an inlet from the passageway to the container is positioned, relative to the anode, within a distance that is less than or equal to 5 times the shortest cross-sectional dimension of the anode.

In some embodiments, the system comprises a container configured for molten salt electrolysis, a passageway fluidically connected to the container and configured for feeding solid material and an inert gas into the container, one or more anodes, wherein each anode is positioned at least partially within the container, one or more cathodes, wherein each cathode is positioned at least partially within the container, and an outlet at or near the top of the container configured for releasing a gas from the container; wherein an inlet from the passageway to the container is positioned closer to one of the anodes than to any of the cathodes.

Other advantages and novel features of the present disclosure will become apparent from the following detailed description of various non-limiting embodiments of the disclosure when considered in conjunction with the accompanying figures. In cases where the present specification and a document incorporated by reference include conflicting and/or inconsistent disclosure, the present specification shall control.

BRIEF DESCRIPTION OF THE DRAWINGS

Non-limiting embodiments of the present disclosure will be described by way of example with reference to the accompanying FIGURES, which are schematic and are not intended to be drawn to scale unless otherwise indicated. In the FIGURES, each identical or nearly identical component illustrated is typically represented by a single numeral. For purposes of clarity, not every component is labeled in every FIGURE, nor is every component of each embodiment of the disclosure shown where illustration is not necessary to allow those of ordinary skill in the art to understand the disclosure. In the FIGURES.

DETAILED DESCRIPTION

Figure 1A:
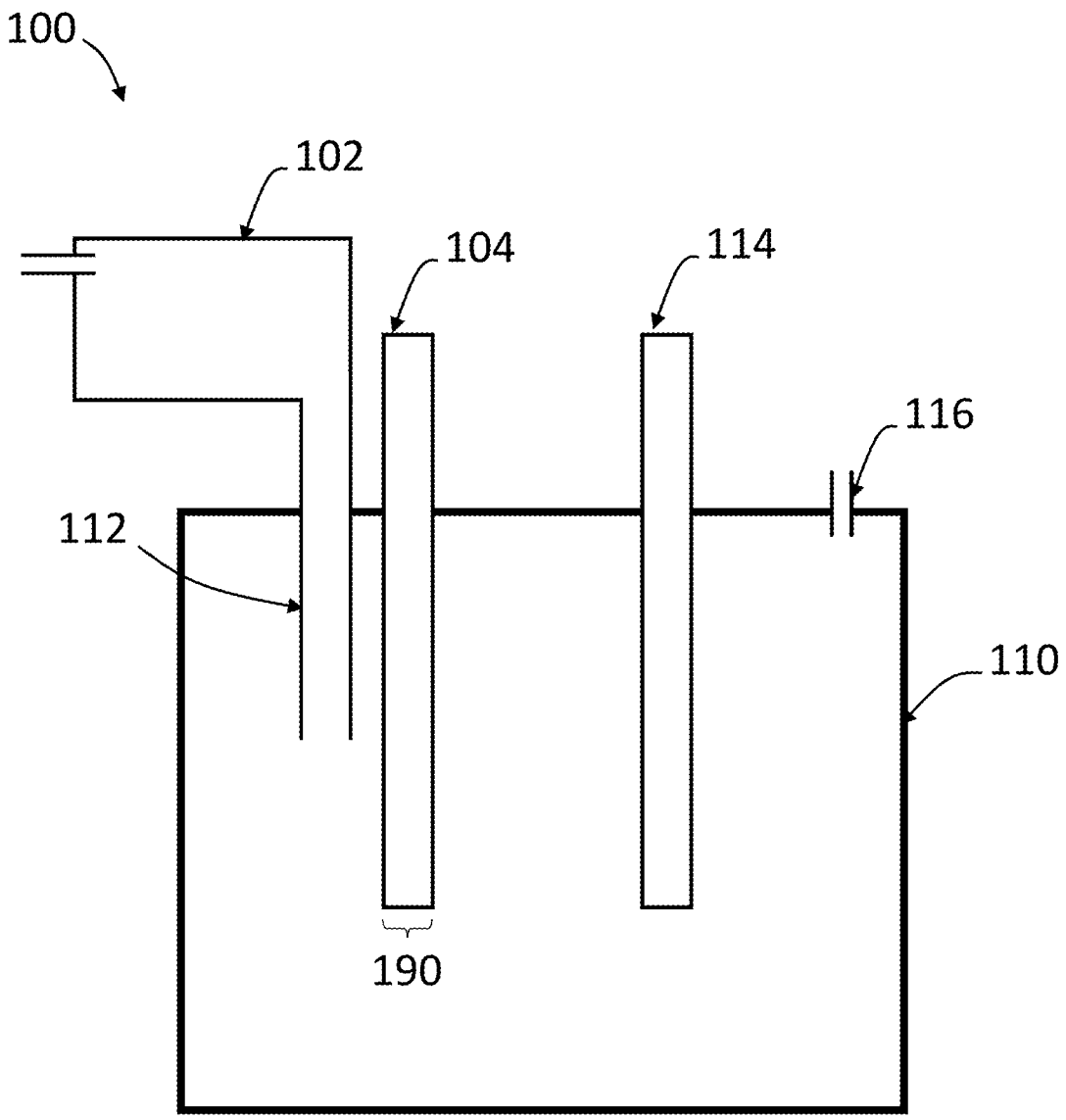
FIG. 1A is a cross-sectional schematic illustration of a system in which solid material and a gas are fed into a container of an electrolytic cell, according to certain embodiments.

The present disclosure is directed to systems and methods for feeding solid material and a gas into an electrolytic cell. Certain aspects are related to feeding solid material and a gas into an electrolytic cell through an inlet. In certain embodiments, the inlet can be positioned such that it is relatively close to one or more anodes of the electrolytic cell.

As will be described in more detail below, certain methods described herein relate to electrolytic cells and certain systems described herein are suitable for containing an electrolytic cell. Electrolytic cells may be capable of performing and/or configured to perform one or more redox reactions upon the input of electrical energy. The reactions that occur upon the input of such electrical energy may also be referred to as electrolytic reactions, and the process of operating an electrolytic cell to perform such reactions may be referred to as electrolysis. Operation of an electrolytic cell may comprise generating a voltage difference of one or more anodes present in the electrolytic cell with respect to one or more cathodes present therein, which may cause the anode(s) to exhibit a positive charge and the cathode(s) to exhibit a negative charge. The voltage difference may cause an oxidation reaction to occur at the anode and/or a reduction reaction to occur at the cathode.

In some instances, during electrolysis, the anode(s) and cathode(s) present in an electrolytic cell do not react during the redox reactions and so remain unconsumed by these redox reactions. It is also possible for either or both of the anode(s) and the cathode(s) to react during the redox reactions and/or to be consumed by the redox reactions. The redox reactions may comprise reducing metal cations present in the electrolyte to generate, as a desired product, elemental and/or alloyed metal (e.g., a metal having a zero oxidation state). The redox reactions may comprise oxidizing anion counter ions to form, as a byproduct, elemental gases.

Some embodiments are directed to methods in which a solid material and a gas are fed into an electrolytic cell. The solid material may comprise one or more species that are capable of undergoing and/or are configured to undergo electrolysis in the electrolytic cell. Upon introduction into the electrolytic cell, the solid material may melt and/or be dissolved in the electrolyte. Components thereof may be transported to the anode and/or the cathode to undergo one or more redox reactions. As one example, in some embodiments, a solid material comprises a salt comprising a metal cation. In such embodiments, the metal cation may be reduced at the cathode to form a metallic product, such as elemental and/or alloyed metal.

Gas introduced with the solid material may assist with maintaining an atmosphere in the electrolytic cell that is conducive to performing electrolysis. For instance, it may be relatively inert with respect to the components of the electrolytic cell. As another example, it may assist with maintaining a pressure in the electrolytic cell such that other, more reactive gases (e.g., water) are not pulled into the electrolytic cell via a pressure gradient.

In some embodiments, a solid material and a gas are fed into an electrolytic cell at a location that is desirably close to one or more anodes present in the electrolytic cell and/or desirably far from one or more cathodes present in the electrolytic cell. For instance, in some embodiments, a solid material and a gas are fed into an electrolytic cell at a location that is closer to an anode than to any cathode or cathodes also present in the electrolytic cell. Such a design may advantageously improve anode and/or cathode performance.

As one example, feeding a solid material and a gas into an electrolytic cell at a location that is relatively far from the cathodes of the electrolytic cell may reduce and/or eliminate drawbacks associated with introducing such species too close to a cathode. One such drawback is the accumulation of the solid material at the cathode(s). When an appreciable amount of such accumulation occurs, it undesirably forms a sludge that hinders access to the cathode by additional solid material being fed into the electrolytic cell, thereby increasing the resistance of the electrolytic cell and/or decreasing the rate of the electrolysis reaction performed therein. Accumulation of a solid material at a cathode is believed to occur when solid material contacts the cathode prior to melting and/or dissolution in the electrolyte. Thus, introducing the solid material into the electrolytic cell at a location that is relatively far from the cathodes therein, which may promote a higher level of solid material melting and/or dissolution in the electrolyte prior to cathode contact, is believed to reduce these deleterious phenomena.

In some instances, solid material that is fed into an electrolytic cell at a location that is relatively close to the cathode results in an appreciable amount of the solid material failing to melt or dissolve in the electrolyte and instead accumulating at the bottom of the electrolytic cell. This solid material, because it fails to become solubilized in the electrolyte, fails to be transported to the anode or the cathode or to undergo the electrolytic reactions being performed in the electrolytic cell, thereby undesirably reducing the efficiency of the electrolytic cell.

By contrast, feeding a solid material and a gas into an electrolytic cell at a location that is relatively close to an anode of the electrolytic cell may enhance electrolytic cell performance. In some embodiments, bubbles are generated at the anode as a product or byproduct of the electrolytic reaction(s) occurring there. Such bubbles may serve to render the electrolyte more turbulent in regions closer to the anode, which may facilitate dissolution of the solid material, thereby reducing and/or preventing its accumulation at a cathode and/or in the bottom of the electrolytic cell.

As another example, it may be more facile to feed a solid material and a gas into an electrolytic cell at a location that is relatively close to an anode of electrolytic cell. During operation, electrolytic cells sometimes generate byproducts that interfere with the introduction of solid materials thereto. In such instances, it can be advantageous to add the solid material at a location in which such byproducts have a relatively low (and/or zero) concentration. For instance, electrolytic cells comprising a carbon-containing anode (e.g., a graphite anode) may generate carbon dust that collects on the surface of the electrolyte and floats thereon. This carbon dust may be removed by electrolytic reactions occurring at the anode, and so may have a concentration that is lower in locations closer to the anode(s) but higher in locations farther from the anode(s). As this carbon dust may hinder contact between the solid material and the electrolyte, it may slow the dissolution of the solid material in the electrolyte, which may have the negative effects described elsewhere herein. Accordingly, feeding a solid material into the electrolytic cell at a location that is relatively carbon dust-free, such as a location close to the anode, may be beneficial.

Some embodiments relate to systems, such as systems suitable for performing electrolysis and/or suitable for containing an electrolytic cell. It is also possible for the systems described herein to be capable of performing and/or configured to perform one or more of the methods described herein.

In some embodiments, a system comprises one or more anodes, one or more cathodes, and a container in which the anode(s) and cathode(s) may be at least partially positioned. The container may further contain the electrolyte, such as a molten salt electrolyte. Electrolysis performed in electrolytic cells comprising such an electrolyte may be referred to as molten salt electrolysis.

Some systems may further comprise one or more additional components that facilitate the performance of electrolysis. For instance, the container may include a passageway through which solid material and gas may be fed into the container, and the inlet from this passageway to this container may be positioned closer to one of the anodes than to any of the cathodes. This may be desirable for the reasons provided above.

Another example of a component that can facilitate the performance of electrolysis is an outlet for releasing a gas from the chamber (e.g., an outlet capable of releasing and/or configured to release a gas from the chamber). As noted above, in some instances, one or more gases may be generated during electrolysis. It may be desirable to remove such gas from the chamber during electrolysis in order to prevent the pressure in the chamber from becoming unduly large. Additionally, some such gases may undesirably interfere with the redox reactions occurring the electrolytic cell, react with one or more components present in the electrolytic cell, and/or react with one or more products produced by the redox reactions occurring in the electrolytic cell. Removing such gas may reduce the rate at which the gas accumulates on and/or reacts with other components present in the system and/or an electrolytic cell therein. In some embodiments, the outlet is positioned at or near the top of the container. This may be desirable when the gas to be released is less dense than other components contained within the chamber and so may be transported upwards (and, likely, towards the outlet) via buoyancy.

Certain embodiments of this disclosure provide a precise, inert passageway for feeding solid material and a gas into high temperature (e.g., greater than or equal to 500 degrees Celsius) molten salt electrolysis cells (also referred to herein as electrolytic cells). Upon introduction into the electrolytic cell, the solid material may melt and/or dissolve in electrolyte present therein. In certain embodiments, the arrangements described herein can be configured such that volatile species that come off the molten salt do not condense on an inlet from the passageway to the electrolytic cell, which would otherwise cause clogging and shortened lifetime of passageway components. In accordance with some embodiments, the system can be arranged to avoid hand feeding material into the cell at known frequencies by an operator or technician. Certain embodiments comprise usage of a purely mechanical passageway.

Certain embodiments of this disclosure involve an inlet from a passageway into a container of an electrolytic cell. An inlet may comprise one or more openings through which a solid material and/or a gas may be fed into the electrolytic cell and/or the container therein. In some instances, an inlet may be located, relative to an anode of the electrolytic cell, within a distance that is less than or equal to 5 times (or less than or equal to 4 times, less than or equal to 3 times, less than or equal to 2 times, or less than or equal to 1 time) the shortest cross-sectional dimension of the anode. As noted above, it is also possible for the inlet to be located closer to an anode present in the electrolytic cell than to any of the cathodes located therein.

The distance between an electrode (e.g., an anode, a cathode) and an inlet may be determined by measuring the distance from the opening(s) of the inlet to the portion(s) of the electrode to which it is closest (i.e., the portion of the electrode that minimizes the distance measurement). The smallest distance measured by this process is equivalent to the distance between the electrode and the inlet.

In some embodiments, material throughput (e.g., adding solid material to the cell and melting and/or dissolving the solid material) is higher relative to that in previous systems due, at least in part, to the location of the inlet relative to the anode. In certain embodiments, the amount of solid material that can be melted, and/or fed to and/or dissolved within a molten salt of the electrolytic cell can be at least 1 g/hour, at least 10 g/hour, at least 50 g/hour, at least 100 g/hour, or more. In certain embodiments, the amount of solid material that can be melted, and/or fed to and/or dissolved within a molten salt of the electrolytic cell can be less than or equal to 1 kg/hour, less than or equal to 500 g/hour, or less than or equal to 150 g/hour. Combinations of these ranges are also possible. Other ranges are also possible.

In some embodiments, an electrolytic cell described herein can be run at a higher current relative to the current at which other systems are run due, at least in part, to the location of the inlet relative to the anode. In some embodiments, the electrolytic cell can be run at a current of at least 1 amp, at least 10 amps, at least 50 amps, at least 100 amps, at least 500 amps, at least 1,000 amps, at least 5,000 amps, at least 10,000 amps, at least 50,000 amps, at least 100,000 amps, at least 500,000 amps, at least 1,000,000 amps, at least 5,000,000 amps, at least 10,000,000 amps, at least 5,000,000 amps, or more. In certain embodiments, the electrolytic cell can be run at a current of less than or equal to 100,000,000 amps, less than or equal to 50,000,000 amps, less than or equal to 10,000,000 amps, less than or equal to 5,000,000 amps, less than or equal to 1,000,000 amps, less than or equal to 500,000 amps, less than or equal to 100,000 amps, less than or equal to 50,000 amps, less than or equal to 10,000 amps, less than or equal to 1000 amps, less than or equal to 500 amps, less than or equal to 200 amps, or less. Combinations of these ranges are also possible. Other ranges are also possible.

In some embodiments, the location of the inlet adjacent to the anode(s) (e.g., closer to one of the anodes than to any of the cathodes of the electrolytic cell) facilitates dissolution of solid material entering the container through the inlet (e.g., into the molten salt). The melting and/or dissolution time of solid material into molten salt may be less than or equal to 5 minutes, less than or equal to 3 minutes, or less than or equal to 1 minute. The melting and/or dissolution time of solid material into molten salt may be greater than or equal to 1 second, greater than or equal to 10 seconds, or greater than or equal to 30 seconds. Combinations of the above-referenced ranges are also possible (e.g., greater than or equal to 1 second and less than or equal to 5 minutes, greater than or equal to 10 seconds and less than or equal to 3 minutes, greater than or equal to 30 seconds and less than or equal to 1 minute). Other ranges are also possible. In some embodiments, melting and/or dissolution of at least a portion of the solid material into the molten salt may be instant.

Without wishing to necessarily be bound by any particular theory, it is believed that short melting and/or dissolution times may be due to off gasses at the anode(s) causing turbulent mixing (e.g., Reynolds number greater than 2000) of the fed solid material, facilitating the quick dissolution of the solid material in the molten salt. In some embodiments, an anode (e.g., an anode at which bubbles are generated) and/or bubbles generated by an anode may turbulently mix a liquid and/or an electrolyte (e.g., a liquid and/or an electrolyte in the vicinity of the anode, such as a molten salt in the vicinity of the anode). In some embodiments, the solid material is exposed to (and/or a liquid proximate the anode has) a Reynolds number greater than or equal to 100, greater than or equal to 200, greater than or equal to 500, greater than or equal to 1,000, greater than or equal to 2,000, greater than or equal to 3,000, greater than or equal to 4,000, or greater than or equal to 7,500. In some embodiments, the solid material is exposed to (and/or a liquid proximate the anode has) a Reynolds number less than or equal to 10,000, less than or equal to 8,000, less than or equal to 6,000, less than or equal to 5,000, less than or equal to 4,000, less than or equal to 3,000, less than or equal to 2,000, less than or equal to 1,000, less than or equal to 500, or less than or equal to 200. Combinations of the above-referenced ranges are also possible (e.g., greater than or equal to 100 and less than or equal to 10,000, greater than or equal to 1,000 and less than or equal to 5,000, greater than or equal to 2,000 and less than or equal to 10,000, greater than or equal to 3,000 and less than or equal to 8,000, greater than or equal to 4,000 and less than or equal to 6,000). Other ranges are also possible.

In certain embodiments, the system (e.g., molten salt electrolysis cell) has a passageway (e.g., comprising (e.g., consisting of) SS304, Inconel, Hastelloy C276 or other compatible materials with effluent gas) that is fluidically connected to an inlet to the container. Such an inlet may supply an electrolytic cell positioned in the system with a solid material and/or a gas.

In some embodiments, the passageway is sealed and purged with dry inert gas (e.g., a noble gas, such as argon, nitrogen, or similar). In some embodiments, the passageway is purged with dry inert gas at a rate of at least 5 mL/min, at least 50 mL/min, or at least 100 mL/min. In some embodiments, the passageway is purged with dry inert gas at a rate of at most 1000 mL/min, at most 500 mL/min, or at most 400 mL/min. Combinations of the above-referenced ranges are also possible (e.g., at least 5 mL/min and at most 1000 mL/min, at least 50 mL/min and at most 500 mL/min, at least 100 mL/min and at most 400 mL/min). Other ranges are also possible. In some embodiments, this purge helps facilitate the flow of solid material down into the container (e.g., electrolysis crucible), while preventing volatile salt components from condensing on the inlet of the passageway.

In some embodiments, some (e.g., all) mechanical elements of systems described herein comprise (e.g., consist of) stainless steel (e.g., 304, 316, or some comparable alloy). In some embodiments, valves and other instrumentation have Teflon based seals or all stainless-steel construction (e.g., 304, 316, or some comparable alloy).

In some embodiments, some (e.g., all) parts of the system are designed for long lifetimes (e.g., corrosion rate less than 10 mm/month) resistant against corrosive effluent. In some embodiments, the system is designed to maintain air-tightness in order to prevent moisture from entering the atmosphere of the passageway and/or the container, reacting with the feed solid material, causing clumping and/or negatively affecting the feed rate of the solid material.

Certain embodiments of systems described herein have an integrated passageway that can reliably deliver solid material into a sealed, high temperature, corrosive molten salt electrolytic cell. In certain embodiments, the location and method of feeding solid material into the container (e.g., electrolytic cell) differentiates this system by increasing the dissolution kinetics in the molten salt relative to prior systems. These factors may contribute to a significant cost-reduction from an operating expense point of view over the current state of the art by reducing labor and incorporating automation. In certain embodiments, systems and methods described herein facilitate molten salt electrolysis processes to operate more efficiently and avoid operator error or technician error in the feeding step.

As noted above, certain aspects are related to methods. The methods may be used to feed solid material and a gas into a container (e.g., electrolytic cell).

In certain embodiments, the method comprises feeding solid material and a gas into an electrolytic cell through an inlet. In some embodiments, the method comprises feeding the solid material and the gas, through an electrically isolated or electrically grounded passageway, to and through the inlet. In some embodiments, pressure may be applied during the feeding step. For instance, the gas may be supplied in a manner that causes it to apply a pressure to the solid material and that facilitates the feeding of the solid material into the electrolytic cell. In some embodiments, the passageway comprises a parallelepiped. In some embodiments, the passageway comprises a channel or conduit. In some embodiments, the method comprises releasing a gas from the electrolytic cell through an outlet. In some embodiments, the method comprises dissolving the solid material into a molten salt within the electrolytic cell using gas bubbles produced at the anode. The gas bubbles may comprise products and/or byproducts of a redox reaction occurring in the electrolytic cell, such as halogen gases (e.g., chlorine gas, fluorine gas), $O_2$, and/or $CO_2$.

In certain embodiments, as noted above, an electrolyte present in an electrolytic cell my comprise, consist of, and/or consist essentially of a molten salt. The electrolyte molten salt may comprise, consist of, and/or consist essentially of the material fed into the electrolytic cell as a solid and subsequently melted to form a liquid (e.g., melted by the heat present in the electrolytic cell and/or a container in a system comprising the electrolytic cell). Such electrolyte may further comprise one or more products formed by reactions of this material within the electrolytic cell. It is also possible for the electrolyte to further comprise other molten salts (e.g., a molten salt present in the electrolytic cell prior to the introduction of the solid material thereto, a molten salt that does not undergo a redox reaction in the electrolytic cell).

In some embodiments, a molten salt is a eutectic molten salt. This may advantageously allow for the operation of the electrolytic cell with the molten salt at a relatively low temperature. In some embodiments, a molten salt comprises a molten halide salt. In certain embodiments, the molten salt is a chloride and/or fluoride molten salt. The molten salts may comprise any suitable cation, such as a metal cation. Non-limiting examples of suitable metal cations include alkali metal cations and rare earth metal cations.

As used herein, a "halide" is an anion of a "halogen." The "halogens" are fluorine (F), chlorine (Cl), bromine (Br), iodine (I), astatine (At), and tennessine (Ts).

The "alkali metals" is used herein to refer to the following six chemical elements of Group 1 of the periodic table: lithium (Li), sodium (Na), potassium (K), rubidium (Rb), cesium (Cs), and francium (Fr). The term "alkaline earth metal" is used herein to refer to the six chemical elements in Group 2 of the periodic table: beryllium (Be), magnesium (Mg), calcium (Ca), strontium (Sr), barium (Ba), and radium (Ra).

The "rare earth metals," as used herein, are the lanthanides, yttrium (Y), and scandium (Sc). The "lanthanides," as used herein, are lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), and lutetium (Lu).

In some embodiments, the inlet is positioned, relative to an anode of the electrolytic cell (and/or an anode positioned at least partially within a container), within a distance that is less than or equal to 5 times the shortest cross-sectional dimension of the anode, less than or equal to 4 times the shortest cross-sectional dimension of the anode, less than or equal to 3 times the shortest cross-sectional dimension of the anode, less than or equal to 2 times the shortest cross-sectional dimension of the anode, or less than or equal to 1 time the shortest cross-sectional dimension of the anode. In some embodiments, the inlet is positioned, relative to an anode of the electrolytic cell (and/or an anode positioned at least partially within a container), within a distance that is greater than or equal to 0.01 times the shortest cross-sectional dimension of the anode, greater than or equal to 0.1 times the shortest cross-sectional dimension of the anode, or greater than or equal to 1 times the shortest cross-sectional dimension of the anode. Combinations of the above-referenced ranges are also possible (e.g., greater than or equal to 0.01 times the shortest cross-sectional dimension of the anode and less than or equal to 5 times the shortest cross-sectional dimension of the anode, greater than or equal to 0.1 times the shortest cross-sectional dimension of the anode and less than or equal to 3 times the shortest cross-sectional dimension of the anode, greater than or equal to 1 times the shortest cross-sectional dimension of the anode and less than or equal to 2 times the shortest cross-sectional dimension of the anode). Other ranges are also possible. In some embodiments, the inlet is positioned in contact with the anode.

The shortest cross-sectional dimension of the anode, as used herein, refers to the shortest dimension that passes through the geometric center of the anode and that passes from one external surface of the anode to an opposing external surface of the anode. To illustrate, if the anode is an elongated cylinder with a length larger than the diameter of the cylinder, the shortest cross-sectional dimension of the anode would be the diameter of the anode. If the anode were a sphere, the shortest cross-sectional dimension of the anode would be the diameter of the sphere. If the anode were a cube, the shortest cross-sectional dimension of the anode would be the length from the center of one face of the cube to the center of the opposite face of the cube. In certain embodiments, the anode is cylindrical in shape with its long axis oriented vertically, and the shortest cross-sectional dimension of the anode is the diameter of the anode. In example 1A, for example, the shortest cross-sectional dimension of anode 104 is shown as length 190.

Without wishing to be bound by any particular theory, it is believed that as the shortest cross-sectional dimension of the anode increases in size, bubble formation intensifies and creates a larger volume of aerated molten salt, which permits the inlet to be spaced farther away from the anode. As the anode decreases in size, performance is enhanced when the inlet is closer to the anode.

Without wishing to be bound by any particular theory, it is believed that the tolerance for the distance between the inlet and any anode(s) present in the electrolytic cell may be affected by the viscosity and/or the surface tension of the electrolyte. As noted elsewhere herein, the presence of bubbles generated at the anode may facilitate the dissolution of solid material introduced into the electrolytic cell. It is believed that bubbles generated at the anode in electrolytes that are more viscous may be transported shorter distances from the anode than bubbles generated at the anode in electrolytes that are less viscous. Accordingly, it is believed that, in order for the bubbles to facilitate the dissolution of solid material, the solid material would need to be introduced closer to the anode in electrolytic cells including more viscous electrolytes and could be introduced farther from the anode in electrolytic cells including less viscous electrolytes.

The electrolytes described herein may have a variety of suitable viscosities. In some embodiments, an electrolyte has a viscosity of greater than or equal to 0.001 Pa*s, greater than or equal to 0.002 Pa*s, greater than or equal to 0.005 Pa*s, greater than or equal to 0.0075 Pa*s, greater than or equal to 0.01 Pa*s, greater than or equal to 0.02 Pa*s, greater than or equal to 0.05 Pa*s, greater than or equal to 0.075 Pa*s, greater than or equal to 0.1 Pa*s, greater than or equal to 0.2 Pa*s, greater than or equal to 0.5 Pa*s, or greater than or equal to 0.75 Pa*s. In some embodiments, an electrolyte has a viscosity of less than or equal to 1 Pa*s, less than or equal to 0.75 Pa*s, less than or equal to 0.5 Pa*s, less than or equal to 0.2 Pa*s, less than or equal to 0.1 Pa*s, less than or equal to 0.075 Pa*s, less than or equal to 0.05 Pa*s, less than or equal to 0.02 Pa*s, less than or equal to 0.01 Pa*s, less than or equal to 0.0075 Pa*s, less than or equal to 0.005 Pa*s, or less than or equal to 0.002 Pa*s. Combinations of the above-referenced ranges are also possible (e.g., greater than or equal to 0.001 Pa*s and less than or equal to 1 Pa*s). Other ranges are also possible.

It is also believed that the surface tension of the electrolyte may affect bubble size and bubble formation. Electrolytes having higher surface tensions may require more energy to form bubbles and bubbles that are produced therein may be less stable. This may result in the production of fewer smaller bubbles, which may reduce the utility of the bubbles for assisting with the dissolution of the solid material. Thus, it is believed that, in order for the bubbles to facilitate the dissolution of solid material, the solid material would need to be introduced closer to the anode in electrolytic cells including more electrolytes having higher surface tensions and could be introduced farther from the anode in electrolytic cells including electrolytes having lower surface tension.

The electrolytes described herein may have a variety of suitable surface tensions. In some embodiments, an electrolyte has a surface tension of 0.001 N/m, greater than or equal to 0.002 N/m, greater than or equal to 0.005 N/m, greater than or equal to 0.0075 N/m, greater than or equal to 0.01 N/m, greater than or equal to 0.02 N/m, greater than or equal to 0.05 N/m, greater than or equal to 0.075 N/m, greater than or equal to 0.1 N/m, greater than or equal to 0.2 N/m, greater than or equal to 0.5 N/m, or greater than or equal to 0.75 N/m. In some embodiments, an electrolyte has a surface tension of less than or equal to 1 N/m, less than or equal to 0.75 N/m, less than or equal to 0.5 N/m, less than or equal to 0.2 N/m, less than or equal to 0.1 N/m, less than or equal to 0.075 N/m, less than or equal to 0.05 N/m, less than or equal to 0.02 N/m, less than or equal to 0.01 N/m, less than or equal to 0.0075 N/m, less than or equal to 0.005 N/m, or less than or equal to 0.002 N/m. Combinations of the above-referenced ranges are also possible (e.g., greater than or equal to 0.001 N/m and less than or equal to 1 N/m). Other ranges are also possible.

In some embodiments, the gas comprises an inert gas. For instance, an inert gas may be fed into an electrolytic cell and/or a container. This feeding may be performed together with the feeding of a solid material into the electrolytic cell (and/or container) and/or through the same inlet through which a solid material is fed into the electrolytic cell (and/or container). It is also possible for the inert gas to be fed into an electrolytic cell (and/or container) separately from a solid material (e.g., temporally and/or spatially). In some embodiments, the gas fed into the electrolytic cell comprises a noble gas, $CO_2$, $N_2$, and/or forming gas. As noted above, in some embodiments, the gas may comprise, consist essentially of, and/or consist of an inert gas. Non-limiting examples of suitable inert gases include argon and $N_2$. In some embodiments, the inert gas prevents solid material from depositing onto the passageway or inlet.

In some embodiments, less than or equal to 1 mol %, less than or equal to 0.5 mol %, or less than or equal to 0.1 mol % of the gas fed into the electrolytic cell reacts with the contents of the electrolytic cell (and/or container) as the gas passes through the electrolytic cell (and/or container). In some embodiments, greater than or equal to 0 mol %, greater than or equal to 0.001 mol %, or greater than or equal to 0.01 mol % of the gas fed into the electrolytic cell reacts with the contents of the electrolytic cell as the gas passes through the electrolytic cell (and/or container). Combinations of the above-referenced ranges are also possible (e.g., greater than or equal to 0 mol % and less than or equal to 1 mol %, greater than or equal to 0.001 mol % and less than or equal to 0.5 mol %, greater than or equal to 0.01 mol % and less than or equal to 0.1 mol %). Other ranges are also possible.

In some embodiments, less than 1 mol % of the gas fed into the electrolytic cell (and/or container) reacts with the contents of the electrolytic cell as the gas passes through the electrolytic cell (and/or container).

In some embodiments, the method comprises flowing the gas through the passageway at a rate of at least 5 mL/min, at least 50 mL/min, or at least 100 mL/min. In some embodiments, the method comprises flowing the gas through the passageway at a rate of less than or equal to 5 L/min, less than or equal to 1 L/min, less than or equal to 500 mL/min, or less than or equal to 400 mL/min. Combinations of the above-referenced ranges are possible (e.g., at least 5 mL/min and less than or equal to 5 L/min, at least 5 mL/min and less than or equal to 1000 mL/min, at least 50 mL/min and less than or equal to 500 mL/min, at least 100 mL/min and less than or equal to 400 mL/min). Other ranges are also possible.

As noted above, certain aspects are related to systems. FIGS. 1A, 1C, and 1D are cross-sectional schematic illustrations of examples of such systems. As noted above, such systems may be suitable for containing and/or may contain an electrolytic cell. Accordingly, such systems may comprise one or more electrolytic cell components.

In certain embodiments, the system comprises a container. In some embodiments, the container is configured for molten salt electrolysis. In some embodiments, the container contains an electrolytic cell.

In certain embodiments, the system comprises a passageway. In some embodiments, the passageway is fluidically connected to the container (and/or an electrolytic cell). In some embodiments, the passageway is configured for feeding solid material and a gas into the container (and/or electrolytic cell). The passageway may comprise an inlet through which the solid material and gas can be fed into the container (and/or electrolytic cell). It is also possible for the passageway to comprise a port for supplying both a gas and a solid material to the passageway, a port for supplying a gas to the passageway, and/or a port for supplying a solid material to the passageway. Such port(s) may be positioned upstream from the inlet. When present, the port for supplying the solid material to the passageway may be fluidically connected to a hopper configured to supply the passageway with the solid material.

In some embodiments, a passageway has one or more features that enhance system and/or electrolytic cell performance. For instance, and as noted elsewhere herein, this inlet may be positioned closer to one of the anodes in the container than to any of the cathodes therein. As another example, in some embodiments, a passageway has a temperature in its interior that is sufficiently high to reduce the amount of liquid water that is introduced into an electrolytic cell therethrough. The temperature of the interior of the passageway may also, in some embodiments, be lower than that of the interior of the electrolytic cell and/or of a container into which it feeds solid material and/or gas. This may allow for a material to be introduced into the electrolytic cell and/or container as a solid material, but be readily melted and/or dissolved after such introduction. As it may be easier to introduce a material in solid form than in liquid form, this may be advantageous. As a third example, in some embodiments, the passageway is electrically isolated. In some embodiments, the passageway comprises a helical drive feeder.

In some embodiments, a temperature of the interior of a passageway is greater than or equal to 50° C., greater than or equal to 75° C., greater than or equal to 100° C., greater than or equal to 150° C., greater than or equal to 200° C., greater than or equal to 300° C., greater than or equal to 400° C., greater than or equal to 500° C., greater than or equal to 600° C., greater than or equal to 700° C., or greater than or equal to 800° C. In some embodiments, a temperature of the interior of a passageway is less than or equal to 900° C., less than or equal to 800° C., less than or equal to 700° C., less than or equal to 600° C., less than or equal to 500° C., less than or equal to 400° C., less than or equal to 300° C., less than or equal to 200° C., less than or equal to 150° C., less than or equal to 100° C., or less than or equal to 75° C. Combinations of the above-referenced ranges are also possible (e.g., greater than or equal to 50° C. and less than or equal to 900° C., or greater than or equal to 100° C. and less than or equal to 600° C.). Other ranges are also possible.

As noted above, in some embodiments, a system described herein comprises a container. The container may have a variety of suitable compositions and designs. One non-limiting example of a suitable container is a graphite crucible.

In some embodiments, a temperature of the interior of a container (and/or an electrolytic cell) is greater than or equal to 100° C., greater than or equal to 200° C., greater than or equal to 300° C., greater than or equal to 400° C., greater than or equal to 500° C., greater than or equal to 600° C., greater than or equal to 700° C., greater than or equal to 800° C., greater than or equal to 900° C., greater than or equal to 1000° C., greater than or equal to 1100° C., greater than or equal to 1200° C., greater than or equal to 1300° C., greater than or equal to 1400° C., greater than or equal to 1500° C., greater than or equal to 1750° C., greater than or equal to 2000° C., or greater than or equal to 2500° C. In some embodiments, a temperature of the interior of a container (and/or an electrolytic cell) is less than or equal to 2500° C., less than or equal to 2000° C., less than or equal to 1750° C., less than or equal to 1500° C., less than or equal to 1400° C., less than or equal to 1300° C., less than or equal to 1200° C., less than or equal to 1100° C., less than or equal to 1000° C., less than or equal to 900° C., less than or equal to 800° C., less than or equal to 700° C., less than or equal to 600° C., less than or equal to 500° C., less than or equal to 400° C., less than or equal to 300° C., or less than or equal to 200° C. Combinations of the above-referenced ranges are also possible (e.g., greater than or equal to 100° C. and less than or equal to 2500° C., or greater than or equal to 700° C. and less than or equal to 1500° C.). Other ranges are also possible.

In some embodiments, an interior of a container (and/or an electrolytic cell) includes a relatively low amount of water. Water may corrode components of the container and/or the electrolytic cell, interfere with the redox reactions performed therein, engage in reactions that compete with the redox reactions performed therein, and/or undergo undesirable reactions with products of the redox reactions performed therein. Accordingly, it is believed that a relatively low amount of water in such locations may be desirable.

In some embodiments, a water content of an interior of an electrolytic cell and/or a container is less than or equal to 5 wt %, less than or equal to 4 wt %, less than or equal to 3 wt %, less than or equal to 2 wt %, less than or equal to 1 wt %, less than or equal to 0.75 wt %, less than or equal to 0.5 wt %, less than or equal to 0.2 wt %, less than or equal to 0.1 wt %, less than or equal to 0.075 wt %, less than or equal to 0.05 wt %, less than or equal to 0.02 wt %, or less than or equal to 0.01 wt % of the gases and/or liquids present in the interior of the electrolytic cell and/or the container. In some embodiments, a water content of an interior of an electrolytic cell and/or a container is greater than or equal to 0 wt %, greater than or equal to 0.01 wt %, greater than or equal to 0.02 wt %, greater than or equal to 0.05 wt %, greater than or equal to 0.075 wt %, greater than or equal to 0.1 wt %, greater than or equal to 0.2 wt %, greater than or equal to 0.5 wt %, greater than or equal to 0.75 wt %, greater than or equal to 1 wt %, greater than or equal to 2 wt %, greater than or equal to 3 wt %, or greater than or equal to 4 wt % of the gases and/or liquids present in the interior of the electrolytic cell and/or the container. In some embodiments, the interior of an electrolytic cell and/or a container includes exactly 0 wt % water. Combinations of the above-referenced ranges are also possible (e.g., less than or equal to 5 wt % and greater than or equal to 0 wt %, or less than or equal to 1 wt % and greater than or equal to 0 wt %). Other ranges are also possible.

In some embodiments, a water content of the gases in the interior of an electrolytic cell is in one or more of the above-referenced ranges. In some embodiments, a water content of the liquids in the interior of an electrolytic cell is in one or more of the above-referenced ranges. In some embodiments, a water content of the gases and liquids in the interior of an electrolytic cell together is in one or more of the above-referenced ranges.

In certain embodiments, the system (and/or an electrolytic cell therein) comprises an anode. In some embodiments, the anode is at least partially within the container. It is also possible for a system and/or an electrolytic cell to comprise more than one anode. In such instances, such anodes may also be positioned at least partially within the container. It is also possible for one or more anodes present in a system and/or an electrolytic cell to be fully positioned within a container.

The anodes described herein may have a variety of suitable compositions. In some embodiments, an anode comprises a material that is not present in the product of any redox reactions occurring thereat and/or is present in such products to a relatively low degree. In some embodiments, an anode comprises a material that does not take place in any redox reactions during electrolytic cell operation and/or takes place in such reactions to a relatively low degree. One non-limiting example of a suitable material for inclusion in an anode is graphite.

In some embodiments, an inlet from the passageway to the container (and/or electrolytic cell) is positioned, relative to the anode, within a distance that is less than or equal to 5 times the shortest cross-sectional dimension of the anode, less than or equal to 4 times the shortest cross-sectional dimension of the anode, less than or equal to 3 times the shortest cross-sectional dimension of the anode, less than or equal to 2 times the shortest cross-sectional dimension of the anode, or less than or equal to 1 time the shortest cross-sectional dimension of the anode. In some embodiments, the inlet is positioned, relative to the anode, within a distance that is greater than or equal to 0.01 times the shortest cross-sectional dimension of the anode, greater than or equal to 0.1 times the shortest cross-sectional dimension of the anode, or greater than or equal to 1 times the shortest cross-sectional dimension of the anode. Combinations of the above-referenced ranges are also possible (e.g., greater than or equal to 0.01 times the shortest cross-sectional dimension of the anode and less than or equal to 5 times the shortest cross-sectional dimension of the anode, greater than or equal to 0.1 times the shortest cross-sectional dimension of the anode and less than or equal to 3 times the shortest cross-sectional dimension of the anode, greater than or equal to 1 times the shortest cross-sectional dimension of the anode and less than or equal to 2 times the shortest cross-sectional dimension of the anode). Other ranges are also possible. In some embodiments, the inlet is positioned in contact with the anode.

In certain embodiments, an upstream point of the inlet marks the point at which the solid material starts to flow freely from the passageway.

In some embodiments, the anode is a first anode and the system further comprises a second anode. In some embodiments, the inlet is located, relative to the first anode and the second anode, within a distance that is less than or equal to 5 times the shortest cross-sectional dimension of the first anode and the second anode. In some embodiments, the system further comprises a third anode. In some embodiments, the inlet is located, relative to the first anode, the second anode, and the third anode, within a distance that is less than or equal to 5 times the shortest cross-sectional dimension of the first anode and the second anode.

In embodiments in which an electrolytic cell comprises two or more anodes, the distance between the inlet and the anodes may be selected such that sum of the distances from the inlet to each anode is kept relatively small. For instance, in an electrolytic cell that comprises two or more anodes, the inlet may be positioned such that it is equidistant from the anodes (e.g., at the point that is equidistant from the anodes that is also closest to the anodes).

In certain embodiments, the system (and/or an electrolytic cell therein) comprises a cathode. In some embodiments, the cathode is at least partially within the container. In some embodiments, the cathode is a first cathode and the system further comprises a second cathode. In some embodiments, the system further comprises a third cathode. In other words, the systems and electrolytic cells described herein may comprise more than one cathode. In such instances, such cathodes may also be positioned at least partially within the container. It is also possible for one or more cathodes present in a system and/or an electrolytic cell to be fully positioned within a container.

The cathodes described herein may have a variety of suitable compositions. In some embodiments, a cathode comprises a material that is not present in the product of any redox reactions occurring thereat and/or is present in such products to a relatively low degree. In some embodiments, a cathode comprises a material that does not take place in any redox reactions during electrolytic cell operation and/or takes place in such reactions to a relatively low degree. One non-limiting example of a suitable material for inclusion in a cathode is tungsten.

In certain embodiments, a ratio of the number of anodes to the number of cathodes in the system is at least 1:1, at least 2:1, at least 3:1, at least 4:1, at least 5:1, at least 6:1, or at least 7:1. In certain embodiments, a ratio of the number of anodes to the number of cathodes in the system is at most 15:1, at most 14:1, at most 13:1, at most 12:1, at most 11:1, at most 10:1, at most 9:1, or at most 8:1. Combinations of the above-referenced ranges are also possible (e.g., at least 1:1 and at most 15:1, at least 2:1 and most 14:1, at least 3:1 and at most 13:1). Other ranges are also possible. In certain embodiments, a ratio of the number of anodes to the number of cathodes in the system is 1:1 (e.g., for a system comprising magnesium). In certain embodiments, a ratio of the number of anodes to the number of cathodes in the system is 15:1 (e.g., for a system comprising aluminum).

In certain embodiments, the system comprises an outlet. In some embodiments, the outlet is positioned at or near the top of the container (and/or electrolytic cell). For instance, in some embodiments, the outlet is positioned above an electrolyte present in the container (and/or electrolytic cell), above a passageway present in the container (and/or electrolytic cell), and/or above the inlet of such a passageway. Some outlets may comprise one or more opening(s) that facilitate the removal of one or more species from the container (and/or electrolytic cell). In such instances, the opening(s) may have the above-described positioning. In some embodiments, the outlet is configured for releasing a gas from the container, such as a gas that it is undesirable to include in the chamber (e.g., water vapor, a halogen gas, a product and/or byproduct of an electrolytic reaction occurring in the container and/or electrolytic cell). In such instances, the opening(s) may be configured for gas to flow therethrough and out of the container (and/or electrolytic cell).

In certain embodiments, the system comprises gas flowing through the container (and/or electrolytic cell) from the passageway to the outlet. In some embodiments, the gas flowing through the container comprises a noble gas, $CO_2$, $N_2$, and/or forming gas.

In some embodiments, less than or equal to 1 mol %, less than or equal to 0.5 mol %, or less than or equal to 0.1 mol % of the gas flowed through the container (and/or electrolytic cell) reacts with the contents of the container (and/or electrolytic cell) as the gas passes through the container (and/or electrolytic cell). In some embodiments, greater than or equal to 0 mol %, greater than or equal to 0.001 mol %, or greater than or equal to 0.01 mol % of the gas flowed through the container (and/or electrolytic cell) reacts with the contents of the container (and/or electrolytic cell) as the gas passes through the container (and/or electrolytic cell). Combinations of the above-referenced ranges are also possible (e.g., greater than or equal to 0 mol % and less than or equal to 1 mol %, greater than or equal to 0.001 mol % and less than or equal to 0.5 mol %, greater than or equal to 0.01 mol % and less than or equal to 0.1 mol %). Other ranges are also possible. In some embodiments, less than 1 mol % of the gas flowed through the container (and/or electrolytic cell) reacts with the contents of the container as the gas passes through the container (and/or electrolytic cell).

In certain embodiments, the system comprises molten salt in the container (and/or electrolytic cell). The molten salt may serve as an electrolyte and/or as a component of an electrolyte. In some embodiments, the anode is at least partially within the molten salt. In some embodiments, the cathode is at least partially within the molten salt. In some embodiments, the molten salt comprises a molten halide salt. In certain embodiments, the molten salt is a chloride and/or fluoride molten salt.

In certain embodiments, the system comprises gas bubbles. In some embodiments, the gas bubbles are produced at the anode and in the molten salt. In some embodiments, the gas bubbles increase the dissolution rate of solid material added to the container from the passageway. In some embodiments, the gas bubbles comprise chlorine, $O_2$, and/or $CO_2$.

In certain embodiments, the system comprises an inlet valve configured to isolate the container (and/or electrolytic cell) from the passageway. In some embodiments, the inlet valve is open.

In certain embodiments, the system comprises an outlet valve configured to isolate the container (and/or electrolytic cell) from the outlet. In some embodiments, the outlet valve is open at the same time that the inlet valve is open.

As noted above, in some embodiments, a system comprises a hopper configured to supply the passageway with the solid material. The hopper may have a variety of suitable designs. In some embodiments, the hopper is electrically grounded, which may reduce the potential for the buildup of static electricity on the hopper. In some embodiments, the hopper comprises one or more components that are capable of breaking and/or configured to break solid material added thereto into smaller particles that may be more readily introduced into a passageway and/or through an inlet thereon. Non-limiting examples of such components include a pellet breaker and a vibratory cannon.

FIG. 1A, FIG. 1C and FIG. 1D are cross-sectional schematic illustrations of systems configured to feed solid material and a gas into a container and/or an electrolytic cell, according to certain embodiments.

Figure 1B:
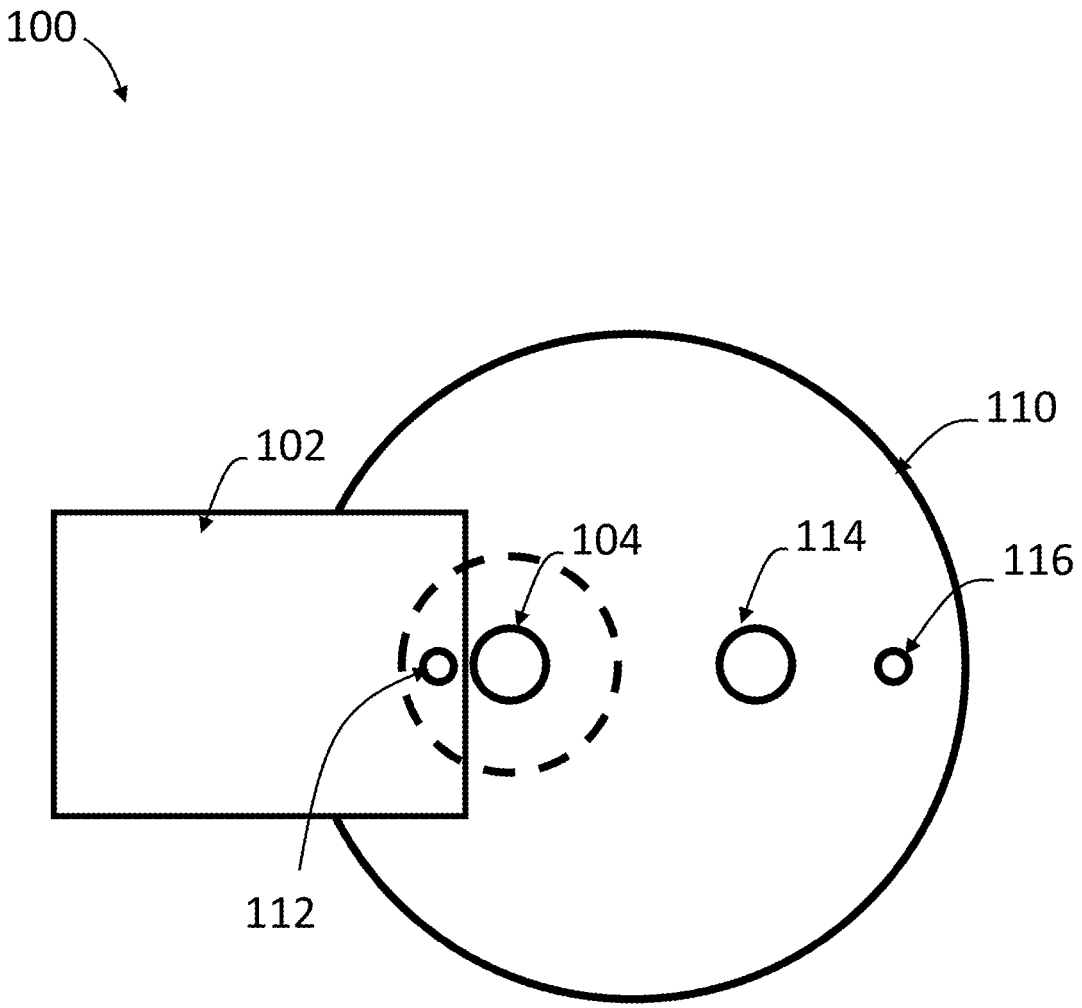
FIG. 1B is a top view schematic illustration of a system configured to feed solid material and a gas into a container of an electrolytic cell, according to certain embodiments.
Figure 1C:
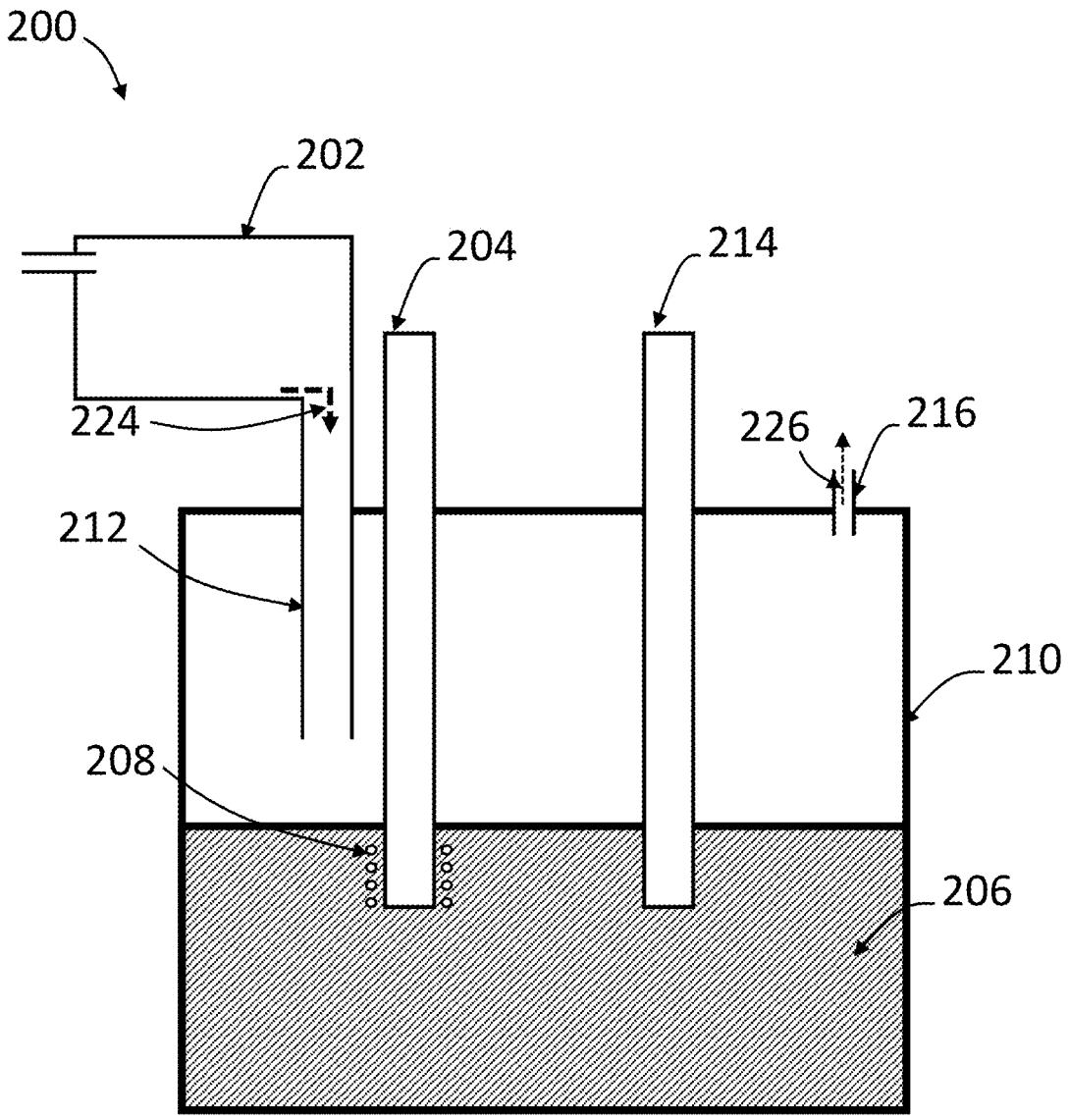
FIG. 1C is, according to some embodiments, a cross-sectional schematic illustration of a system in which solid material and a gas are fed into a container of an electrolytic cell.
Figure 1D:
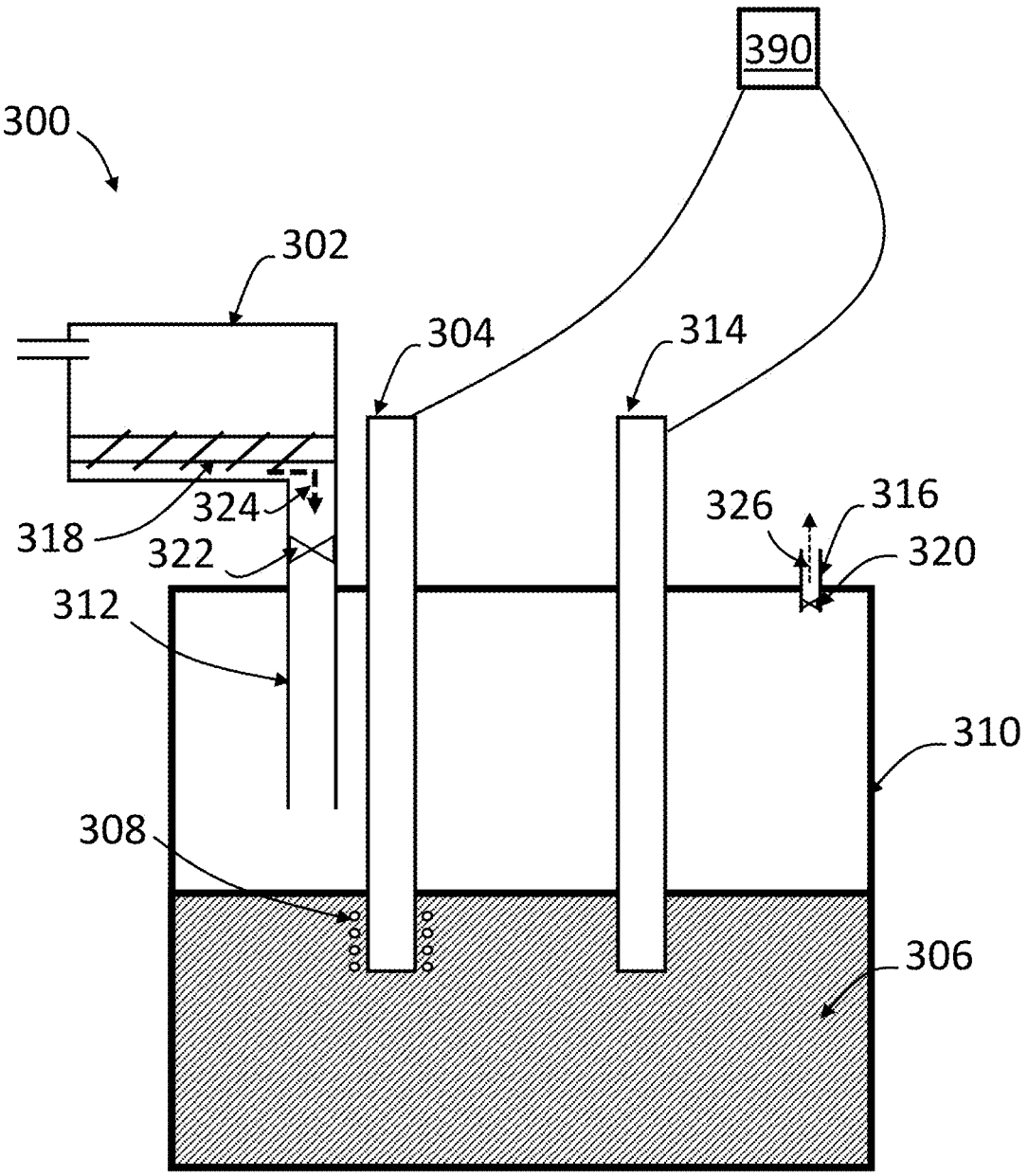
FIG. 1D is a cross-sectional schematic illustration of a system in which solid material and a gas are fed into a container of an electrolytic cell, according to certain embodiments.

FIG. 1B is a top view schematic illustration of a system configured to feed solid material and a gas into a container and/or an electrolytic cell, according to certain embodiments.

FIG. 1A depicts a system 100, comprising: a container 110 configured for molten salt electrolysis; a passageway 102 fluidically connected to container 110 and configured for feeding solid material and a gas into container 110; an anode 104 at least partially within container 110; a cathode 114 at least partially within container 110; and an outlet 116 at or near the top of container 110 configured for releasing a gas from container 110; wherein an inlet 112 from passageway 102 to container 110 is positioned, relative to anode 104, within a distance that is less than or equal to 5 times the shortest cross-sectional dimension of anode 104. As shown in FIG. 1A, the inlet 112 is positioned closer to the anode 104 than to the cathode 114.

FIG. 1B depicts system 100, comprising: container 110 configured for molten salt electrolysis; passageway 102 fluidically connected to container 110 and configured for feeding solid material and a gas into container 110; anode 104 at least partially within container 110; cathode 114 at least partially within container 110; and outlet 116 at or near the top of container 110 configured for releasing a gas from container 110. In FIG. 1B, inlet 112 from passageway 102 to container 110 is positioned, relative to anode 104, within a distance that is less than or equal to 5 times the shortest cross-sectional dimension of anode 104.

FIG. 1C depicts a system 200, comprising: a container 210 configured for molten salt electrolysis; a passageway 202 fluidically connected to container 210 and configured for feeding solid material and a gas into container 210; an anode 204 at least partially within container 210; a cathode 214 at least partially within container 210; and an outlet 216 at or near the top of container 210 configured for releasing a gas from container 210. In FIG. 1C, inlet 212 from passageway 202 to container 210 is positioned, relative to anode 204, within a distance that is less than or equal to 5 times the shortest cross-sectional dimension of anode 204. System 200 further comprises molten salt 206 in container 210. Anode 204 is at least partially within molten salt 206. Cathode 214 is at least partially within molten salt 206. System 200 further comprises gas bubbles 208 produced at anode 204 and in molten salt 206, gas bubbles 208 increasing the dissolution rate of solid material added to container 210 from passageway 202. System 200 further comprises gas flowing through the container from passageway 202 in direction 224 to outlet 216 in direction 226.

FIG. 1D depicts a system 300, comprising: a container 310 configured for molten salt electrolysis; a passageway 302 fluidically connected to container 310 and configured for feeding solid material and a gas into container 310; an anode 304 at least partially within container 310; a cathode 314 at least partially within container 310; and an outlet 316 at or near the top of container 310 configured for releasing a gas from container 310. In FIG. 1D, inlet 312 from passageway 302 to container 310 is positioned, relative to anode 304, within a distance that is less than or equal to 5 times the shortest cross-sectional dimension of anode 304. System 300 further comprises molten salt 306 in container 310. Anode 304 is at least partially within molten salt 306. Cathode 314 is at least partially within molten salt 306. System 300 further comprises gas bubbles 308 produced at anode 304 and in molten salt 306, gas bubbles 308 increasing the dissolution rate of solid material added to container 310 from passageway 302. System 300 further comprises gas flowing through the container from passageway 302 in direction 324 to outlet 316 in direction 326. Passageway 302 comprises a helical drive feeder 318. System 300 further comprises an inlet valve 322 configured to isolate container 310 from passageway 302. System 300 further comprises an outlet valve 320 configured to isolate container 310 from outlet 316.

As noted above, in certain embodiments, the system can be one in which molten salts are used. A "molten salt" is a liquid-phase salt. In some embodiments, a molten salt may comprise, consist essentially of, and/or consist of a salt that is present at a temperature above its melting point. It is also possible for a molten salt to further comprise a dissolved metal and/or a dissolved gas (e.g., a dissolved metal and/or a dissolved gas that is produced by a reaction, such as a redox reaction, occurring in an electrolytic cell present in the system). A molten salt is not the same as a solubilized salt (which is a salt that has been solubilized into its constituent ions within a solvent). In some embodiments, the molten salt is a salt that is in a solid phase when at a temperature of 25° C. and a pressure of 1 atmosphere but that melts to form a liquid phase when heated to or above its melting point.

In some embodiments, the molten salt contains a halogen (e.g., in the form of a halide). Non-limiting examples of molten salts that can be used include molten sodium chloride, molten sodium fluoride, molten potassium chloride, molten potassium fluoride, molten zinc chloride, molten copper chloride, molten iron chloride, molten copper chloride, molten aluminum chloride, or mixtures of any two or more of these or other chlorides. In some embodiments, the molten salt comprises a molten hydroxide salt, such as a molten alkali metal hydroxide and/or a molten alkaline earth metal hydroxide. In some embodiments, the molten salt comprises molten sodium hydroxide. In some embodiments, the molten salt(s) comprises an alkali metal halide (e.g., sodium chloride, potassium chloride), an alkaline metal halide, a rare earth metal halide, a transition metal halide (e.g., ferric chloride), and/or an oxygen-containing salt (e.g., oxide salts containing non-bridging oxygen, oxyhalides, rare earth metal oxides). In some embodiments, metal from the molten salt can be collected at an electrode of the electrolytic cell.

The "transition metals," as used herein, are scandium (Sc), yttrium (Y), lanthanum (La), actinium (Ac), titanium (Ti), zirconium (Zr), hafnium (Hf), rutherfordium (Rf), vanadium (V), niobium (Nb), tantalum (Ta), dubnium (Db), chromium (Cr), molybdenum (Mo), tungsten (W), seaborgium (Sg), manganese (Mn), technetium (Tc), rhenium (Re), bohrium (Bh), iron (Fe), ruthenium (Ru), osmium (Os), hassium (Hs), cobalt (Co), rhodium (Rh), iridium (Ir), meitnerium (Mt), nickel (Ni), palladium (Pd), platinum (Pt), darmstadtium (Ds), copper (Cu), silver (Ag), gold (Au), roentgenium (Rg), zinc (Zn), cadmium (Cd), mercury (Hg), and copernicium (Cn).

Also as noted above, in certain embodiments, the system is an electrolytic cell. In FIG. 1D, for example, the electrolytic cell comprises container 310, molten salt 306 as an electrolyte, anode 304, and cathode 314. Operation of the electrolytic cell may proceed as follows and/or as described elsewhere herein. A source of electrical energy (e.g., source 390 in FIG. 1D) can be connected to the anode and the cathode, and electrical energy from the source can be used to drive a nonspontaneous redox reaction between the anode and the cathode. The source of electrical energy (e.g., an AC power source, a battery, or any other suitable source) can be used to generate a potential difference between the anode and the cathode that forces electrons to flow from the anode to the cathode, which drives the nonspontaneous redox reaction. At the anode, an oxidation half reaction generally occurs, whereas at the cathode, a reduction half-reaction generally occurs. The electrolyte is generally used to facilitate the transport of ions between the anode and the cathode, which balances the charges within the cell as electrons are transported between the anode and the cathode. In some embodiments, during an electrolytic reaction, molten metal may be formed on the surface of the cathode and/or anode.

The solid materials described herein may have a variety of suitable compositions. In some embodiments, a solid material comprises a metal, such as a salt comprising a metal cation. Non-limiting examples of suitable metals include calcium (Ca), aluminum (Al), tin (Sn), silicon (Si), transition metals, and rare earth metals. In some embodiments, a metal cation is a transition metal positioned in the first row (e.g., zinc (Zn), iron (Fe), vanadium (V)) or a transition metal positioned in the second row (e.g., cadmium (Cd)).

One non-limiting example of a suitable solid material is chalcopyrite.

When a solid material comprises a salt, such as a metal salt, a variety of suitable anions may be present. Non-limiting examples of suitable anions include oxide, sulfide, and halide. In other words, the solid material may comprise an oxide salt, a sulfide salt, and/or a halide salt.

It should be noted that it is possible for a metal salt to comprise two or more types of metal cations and/or two or more types of anions.

Any of a variety of metals may be formed in (e.g., at an electrode of) the electrolytic cell. Examples of molten metals that can be contained within the electrolytic cell include, but are not limited to, zinc, cadmium, calcium, aluminum, iron, vanadium, tin, silicon, lanthanides, and/or lanthanide ferroalloys (e.g., ferrodysprosium). In some embodiments, rare earth metals (e.g., cerium (Ce), lanthanum (La), praseodymium (Pr), neodymium (Nd), promethium (Pm), europium (Eu), gadolinium (Gd), samarium (Sm), dysprosium (Dy), yttrium (Y), terbium (Tb), holmium (Ho), erbium (Er), thulium (Tm), ytterbium (Yb), yttrium (Y), and/or lutetium (Lu)) can be formed in the electrolytic cell.

A variety of byproducts may be formed in (e.g., at an electrode of) the electrolytic cells described herein. Non-limiting examples of byproducts that are formed include halogen gases, water (e.g., water vapor), and oxygen gas.

The following examples are intended to illustrate certain embodiments of the present invention, but do not exemplify the full scope of the invention.

Example 1

A 2" iron-dysprosium cell (10 wt % LiF, 90 wt % $DyF_3$) was run with a ¼" iron cathode and a ¼" graphite anode spaced apart 1.5 inches from center to center. While applying current, dysprosium oxide was fed into the cell within ½" of the anode at a rate of 12 g/hour. Dissolution was noted and no dysprosium oxide was found at the bottom of the cell.

While applying current, dysprosium oxide was fed into the cell 1.5 inches away from the anode. The rate of dissolution was much slower, culminating in a pile of dysprosium oxide found at the bottom of the cell.

Example 2

This Example describes the formation of carbon dust during operation of an electrolytic cell and its spatial distribution.

Electrolysis was performed in an electrolytic cell including a container that took the form of a graphite crucible, carbon anodes, and tungsten cathodes. The container further contained 4 kg of a eutectic lithium fluoride-neodymium fluoride electrolyte. Over the course of the electrolysis, 50 g of neodymium oxide and an inert gas were fed into the electrolytic cell through an inlet.

Initially, the performance of the electrolysis resulted in the formation of a 3 mm-thick carbon dust layer disposed on the electrolyte. This layer covered the entirety of the electrolyte surface. At this point, further neodymium oxide added to the electrolytic cell rested on top of the carbon dust instead of dissolving in the electrolyte, and so failed to replenish the electrolytic cell. However, upon continued electrolysis, the carbon dust was eliminated within a diameter of three times the diameter of the anodes. At that point, the remainder of the electrolyte surface remained covered by the carbon dust layer.

Subsequently, neodymium oxide was added to the electrolyte where the carbon dust layer had been eliminated. During the process of neodymium oxide addition, the inlet was positioned such that it fed the neodymium oxide to this location. Over the course of this process, the electrolytic cell was operated at a potentiostatic hold and the current is monitored as a function of time. Upon addition of the neodymium oxide, the current measured increased rapidly, indicating that the neodymium oxide rapidly became solubilized in the electrolyte.

Example 3

This Example describes the effect of inlet location on electrolytic cell performance.

Electrolysis was performed in an electrolytic cell including a container that took the form of a graphite crucible, a graphite anode, and a tungsten cathode. The container further contained 200 g of a eutectic sodium chloride-potassium chloride electrolyte, which exhibited mild signs of hydration prior to the electrolysis.

Electrolysis was performed for one hour, over the course of which 50 g of chalcopyrite was fed into the electrolytic cell through an inlet. The inlet was positioned at a variety of locations having a variety of distances from the graphite anode and the tungsten cathode. During the process of chalcopyrite addition, the electrolytic cell was operated at a potentiostatic hold and the current is monitored as a function of time. When the inlet was relatively close to the anode and relatively far from the cathode, the current measured increased rapidly, indicating that the chalcopyrite rapidly became solubilized in the electrolyte. When the inlet was positioned such that the chalcopyrite was in contact with the anode upon introduction into the electrolytic cell, the current measured increased particularly rapidly, indicating particularly fast solubilization of the chalcopyrite in the electrolyte. By contrast, when the inlet was positioned relatively far from the anode and relatively close to the cathode, the current measured decreased, indicating the formation of a sludge of the chalcopyrite on the cathode.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present invention.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified unless clearly indicated to the contrary. Thus, as a non-limiting example, a reference to "A and/or B," when used in conjunction with open-ended language such as "comprising" can refer, in one embodiment, to A without B (optionally including elements other than B); in another embodiment, to B without A (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

Some embodiments may be embodied as a method, of which various examples have been described. The acts performed as part of the methods may be ordered in any suitable way. Accordingly, embodiments may be constructed in which acts are performed in an order different than illustrated, which may include different (e.g., more or less) acts than those that are described, and/or that may involve performing some acts simultaneously, even though the acts are shown as being performed sequentially in the embodiments specifically described above.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

In the claims, as well as in the specification above, all transitional phrases such as "comprising," "including," "carrying," "having," "containing," "involving," "holding," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A method, comprising:

feeding solid material through an electrically isolated passageway, to and through an opening in an inlet, and into an electrolytic cell; and feeding a gas into the electrolytic cell through the same electrically isolated passageway and opening in the inlet through which the solid material is fed into the electrolytic cell;

wherein:

the gas comprises an inert gas;

the electrolytic cell comprises one or more anodes and one or more cathodes; and the opening in the inlet through which the solid material and the gas are fed into the electrolytic cell is positioned closer to one of the anodes than to any of the cathodes.

2. A method, comprising:

feeding solid material through an electrically isolated passageway, to and through an opening in an inlet, and into an electrolytic cell; and feeding a gas into the electrolytic cell through the same electrically isolated passageway and opening in the inlet through which the solid material is fed into the electrolytic cell;

wherein:

the gas comprises an inert gas; and the opening in the inlet through which the solid material and the gas are fed into the electrolytic cell is positioned, relative to an anode of the electrolytic cell, within a distance that is less than or equal to 5 times the shortest cross-sectional dimension of the anode.

3. The method of claim 1, further comprising releasing a second gas from the electrolytic cell through an outlet.

4. The method of claim 1, further comprising dissolving the solid material into a molten salt within the electrolytic cell using gas bubbles produced at the one or more anodes.

5. The method of claim 4, wherein the molten salt comprises a molten halide salt.

6. The method of claim 1, wherein less than 1 mol % of the gas fed into the electrolytic cell reacts with the contents of the electrolytic cell as the gas passes through the electrolytic cell.

7. The method of claim 1, wherein the gas fed into the electrolytic cell comprises a noble gas, $CO_2$, $N_2$, and/or a forming gas.

8. The method of claim 1, wherein the solid material comprises a rare earth metal.

9. The method of claim 8, wherein the rare earth metal is neodymium or dysprosium.

10. The method of claim 1, wherein the solid material comprises iron.

11. The method of claim 1, wherein the solid material comprises an oxide, a sulfide, and/or a halide salt.

12. The method of claim 1, wherein an interior of the electrolytic cell is at a higher temperature than an interior of the electrically isolated passageway.

13. The method of claim 1, wherein the solid material melts to form a liquid in the interior of the electrolytic cell and/or is dissolved in a liquid present in the interior of the electrolytic cell.

14. The method of claim 13, wherein the liquid is turbulently mixed by the one or more anodes.

15. The method of claim 1, wherein the electrically isolated passageway comprises a port for supplying the inert gas to the electrically isolated passageway upstream from the inlet.

16. The method of claim 1, wherein a water content of the interior of the electrolytic cell is less than or equal to 5 wt % and greater than or equal to 0 wt % of the gases and/or liquids present in the interior of the electrolytic cell.

17. The method of claim 1, wherein the electrically isolated passageway is electrically grounded.

18. The method of claim 1, wherein the electrolytic cell, the inlet, and the electrically isolated passageway are positioned in a system, and wherein the system further comprises a hopper configured to supply the electrically isolated passageway with the solid material.

19. The method of claim 18, wherein the hopper is electrically grounded.

20. The method of claim 18, wherein the hopper comprises a pellet breaker and/or a vibratory cannon.

21. The method of claim 1, further comprising applying pressure during the feeding of the solid material and the gas into the electrolytic cell.

22. The method of claim 1, further comprising feeding the solid material into the electrolytic cell through a second opening in the inlet and feeding the gas into the electrolytic cell through the second opening in the inlet.

23. The method of claim 2, further comprising feeding the solid material into the electrolytic cell through a second opening in the inlet and feeding the gas into the electrolytic cell through the second opening in the inlet.

24. The method of claim 1, wherein the gas fed into the electrolytic cell consists essentially of the inert gas.

25. A method, comprising:

feeding solid material into an electrolytic cell through an opening in an inlet;

feeding a first gas into the electrolytic cell through the same opening in the inlet through which the solid material is fed into the electrolytic cell;

dissolving the solid material into a molten salt within the electrolytic cell using gas bubbles produced at one or more anodes of the electrolytic cell; and releasing a second gas from the electrolytic cell through an outlet, wherein:

the first gas comprises an inert gas;

the electrolytic cell comprises one or more cathodes; and the opening in the inlet through which the solid material and the gas are fed into the electrolytic cell is positioned closer to one of the anodes than to any of the cathodes.

26. A method, comprising:

feeding solid material into an electrolytic cell through an opening in an inlet;

feeding a first gas into the electrolytic cell through the same opening in the inlet through which the solid material is fed into the electrolytic cell;

dissolving the solid material into a molten salt within the electrolytic cell using gas bubbles produced at one or more anodes of the electrolytic cell; and releasing a second gas from the electrolytic cell through an outlet, wherein:

the first gas comprises an inert gas; and the opening in the inlet through which the solid material and the gas are fed into the electrolytic cell is positioned, relative to an anode of the electrolytic cell, within a distance that is less than or equal to 5 times the shortest cross-sectional dimension of the anode.

* * * * *